US005605061A

United States Patent [19]

Durazzani

[11] Patent Number: 5,605,061

[45] Date of Patent: Feb. 25, 1997

[54] WASHING MACHINE WITH IMPROVED FRAME STRUCTURE

[75] Inventor: Piero Durazzani, Porcia, Italy

[73] Assignee: Electrolux Zanussi Elettrodomestici S.p.A., Pordenone, Italy

[21] Appl. No.: 403,673

[22] Filed: Mar. 14, 1995

[30] Foreign Application Priority Data

Mar. 16, 1994 [IT] Italy ..... PN940006 U

[51] Int. Cl.[6] ..... D06F 37/26

[52] U.S. Cl. ..... 68/3 R; 312/228; 312/351.4

[58] Field of Search ..... 68/3 R; 312/228, 312/351.4, 351.7; 134/560, 570, 580, 200

[56] References Cited

U.S. PATENT DOCUMENTS

| | | | |
|---|---|---|---|
| 1,736,949 | 11/1929 | Szekely | 68/3 R |
| 1,790,584 | 1/1931 | Hirschy | 68/3 R |
| 2,287,657 | 6/1942 | Wiscol | 68/3 R |
| 2,712,228 | 7/1955 | Lloyd-Kessel | 68/3 R |
| 3,039,284 | 6/1962 | Shelton et al. | 68/3 R |
| 3,658,397 | 4/1972 | Hofmann-Igl | 312/351.4 |
| 4,936,117 | 6/1996 | Kabeya | 68/3 R |

FOREIGN PATENT DOCUMENTS

| | | | |
|---|---|---|---|
| 2509159 | 1/1983 | France | 312/351.7 |
| 2584746 | 1/1987 | France | 68/3 R |
| 59-49798 | 3/1986 | Japan | 68/3 R |
| 2164666 | 3/1986 | United Kingdom | 68/3 R |

OTHER PUBLICATIONS

EPO 104,497 Apr. 1984 Durazzani.

*Primary Examiner*—Frankie L. Stinson
*Attorney, Agent, or Firm*—Pearne, Gordon, McCoy & Granger

[57] ABSTRACT

A top-loading washing machine including a washer assembly (1) and an appliance exterior having a front (2) and side plates (3, 4). The machine also includes an upper lid (5), an upper control panel (6), and support feet (29). The elements are assembled and supported by a bearing structure having two distinct lower and upper elements (8, 9). The lower element (8) includes a support base provided with respective columns at four corners that extend vertically from the bottom and terminate at the same height. The upper element (9) is provided with respective columns at four corners that extend vertically. The bottoms of said upper columns rest on the tops of the lower columns. The front (2) and side plates (3, 4) of said appliance are made from a single strip of sheet metal, folded so as to fit against said bearing structure in order to enclose completely the respective side and front faces. The plates are provided with extension fitting into grooves in the upper and lower elements.

6 Claims, 6 Drawing Sheets

Fig. 1
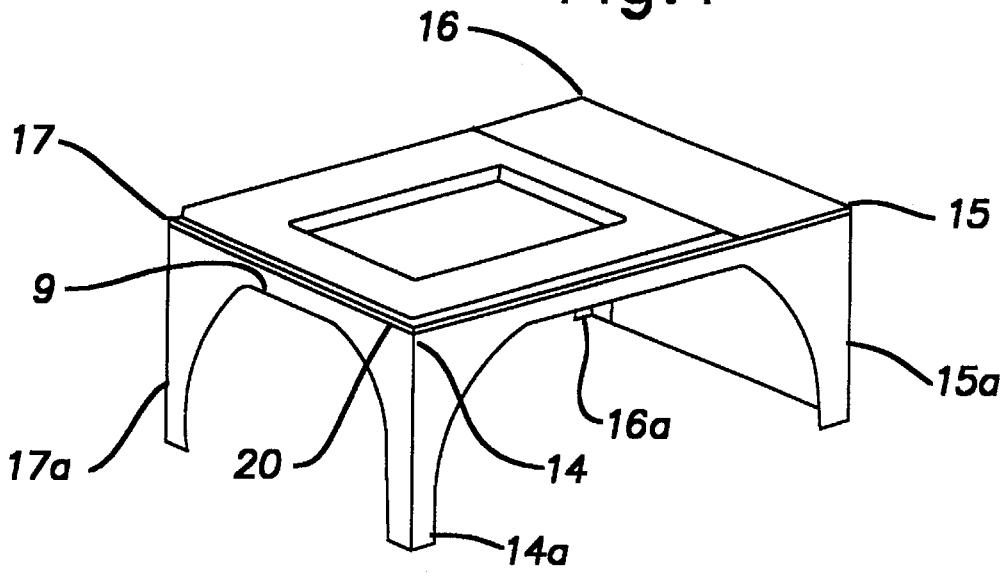
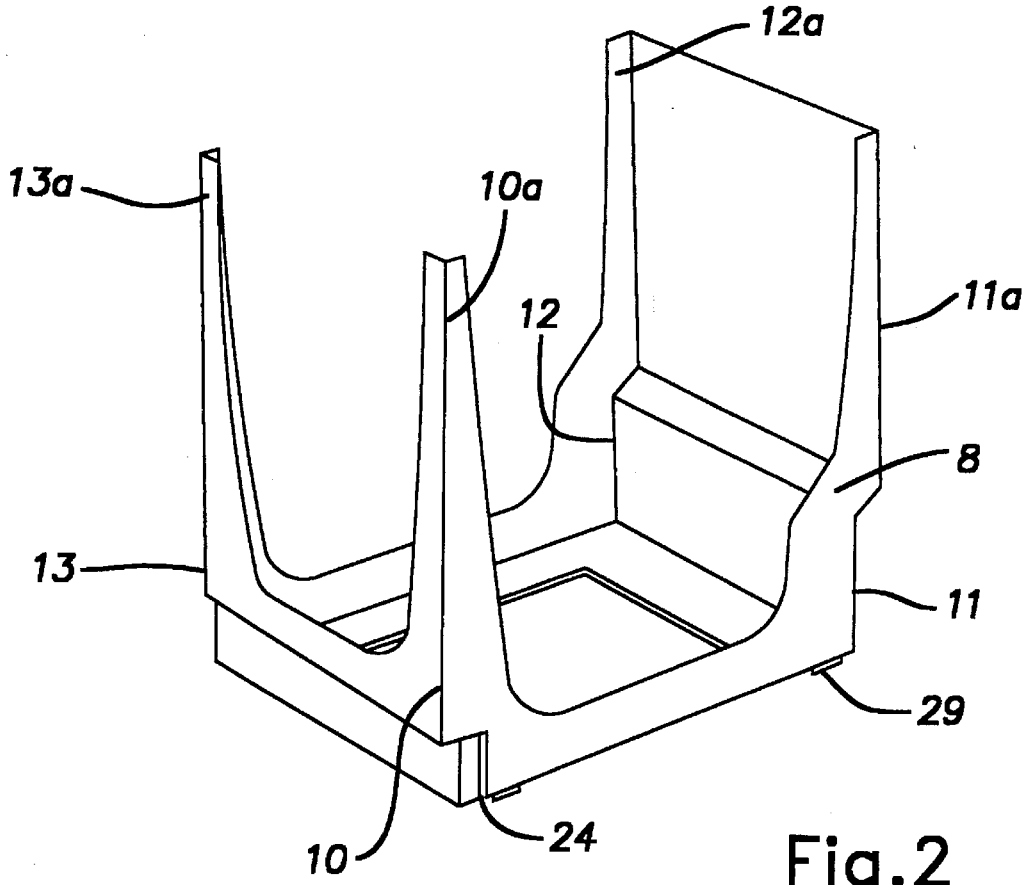
Fig. 2

Fig.7A
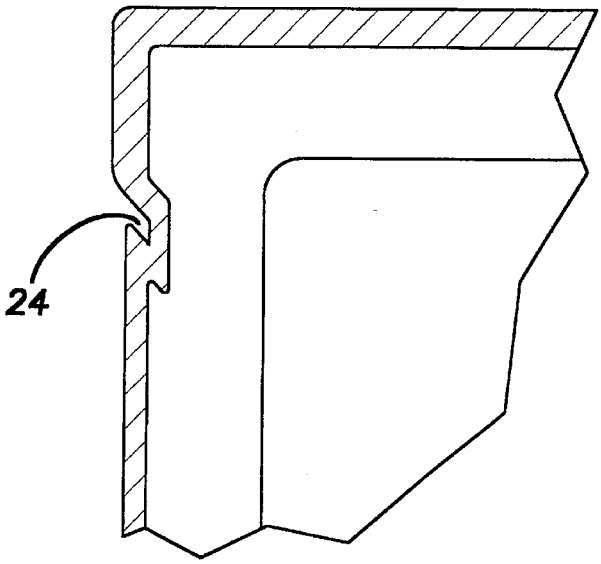
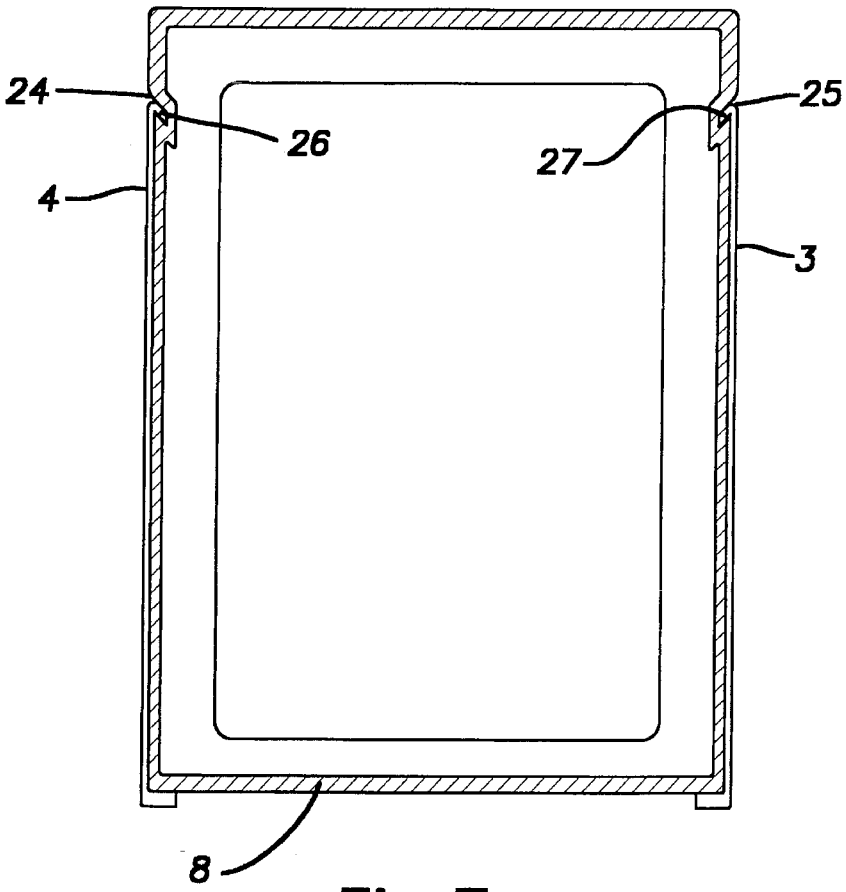
Fig.7

WASHING MACHINE WITH IMPROVED FRAME STRUCTURE

BACKGROUND OF THE INVENTION

The invention concerns an improved frame structure for washing machines, in particular top-loading or front-loading machines for household use.

For the sake of brevity and clarity, the following description and the attached drawings refer to a top-loading washing machine, but the features and the claims are applicable to washing machines of both types.

Washing machines, particularly front-loading machines, including washer assemblies, are made in various ways, generally including a rigid structure made up of a front plate, a bottom plate, two side plates, and a top. These elements are connected together in various ways, and are supported by a base or suitable feet attached to lower edges of the appliance. The base or foot support the entire weight of the apparatus, so that the appliance also supports all the internal parts of the machine. Such appliances are normally made of steel sheet metal, treated to a greater or lesser extent with chemical or electrochemical processes to improve properties of resistance to oxidation. The appliance is also painted or enameled in some cases. Such appliances are shown in European patent application no. 0,104,497, patent application GB 2,164,666, and European patent application no. 0,168,585.

Appliances manufactured in this way are normally satisfactory as far as the characteristics required by and the expectations of the consumer. The technology used for their construction has been tested and continually improved over a period of decades, but has substantially kept to the original technology of sheet-metal working. This requires appropriate support structures in stamped and worked sheet metal or the appliances must be made of particularly thick sheet metal. These alternatives have well-known technical and economic problems and require complicated and costly installations for working the sheet metal and shaping the appliance.

In addition, such washing machines lack any special structural characteristics facilitating use, construction, or recycling because the appliance itself constitutes the bearing structure and is so arranged from the beginning of the assembly process. The assembly process, as well as testing and technical support in use, is more laborious.

In fact, along with the disadvantages stated, the problem of immediate accessibility to the interior during the production phase itself has not been solved, nor have recent requirements for easy, immediate, and economical separation and recovery of the various materials been resolved.

Moreover, requirements are being imposed, by regulations or for commercial reasons, to manufacture products that are easily reusable. A large proportion of the materials of which products are composed must recyclable. Disassembly and separation of the various parts according to their physical and chemical nature, which is an indispensable part of the recycling process, must be easy, fast, safe, and economical.

Also, with the spread of more advanced technologies of industrial automation, it has become evident that simple and unhindered accessibility is a fundamental requirement with household appliances, in both assembly techniques and function testing.

Recently, especially those products made by Japanese manufacturers, plastic appliances for household washing machines have been popularized. Although said appliances have been manufactured for top-loading washing machines, they are merely a plastic version of traditional metal washing machines, with the inconveniences of the type of construction and accessibility already described.

SUMMARY OF THE INVENTION

It would therefore be desirable, and is an object of the present invention, to create a washing machine, particularly for household use, having a modular-type structure. The machine is suitable for assembly in separate and independent phases that can be separated from the exterior of the appliance. This eliminates the difficulties and complications in construction described above and permits easy and rapid disassembly for recovery of a large proportion of the recyclable materials. This avoids complications in construction and uses technology that is now available.

BRIEF DESCRIPTION OF THE DRAWINGS

The invention will be understood from the following description, given only by way of a non-limiting example, with reference to the attached diagrams, in which:

FIGS. 1 and 2, respectively, show upper and lower bearing elements of a washing machine according to the invention;

FIGS. 7 and 7A show a horizontal section of the lower bearing element and a detail thereof, respectively.

DETAILED DESCRIPTION OF THE PREFERRED EMBODIMENTS

Figure 4:
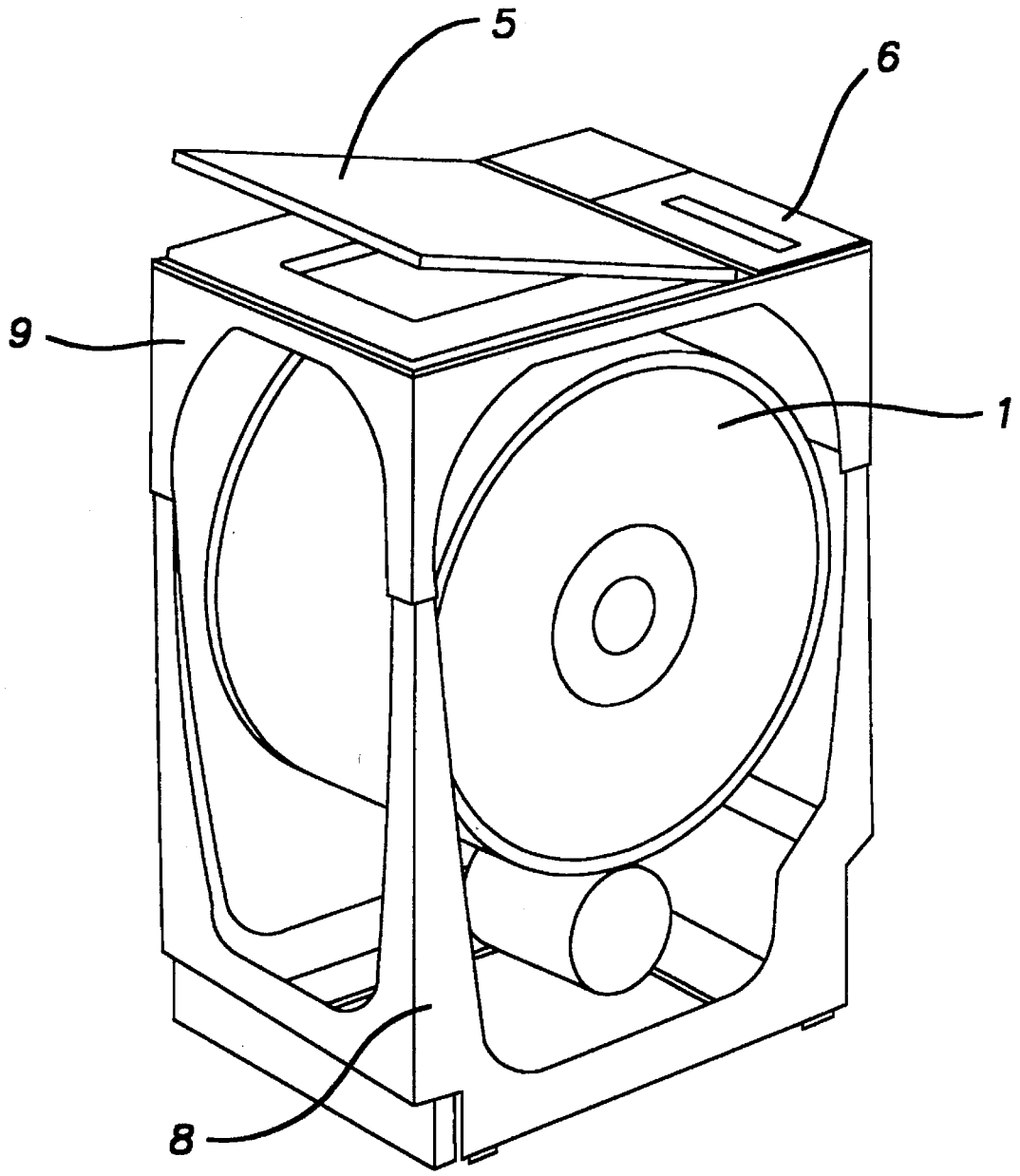
FIG. 4 illustrates the arrangement of the washer assembly within the assembled structure in FIG. 3.
Figure 5:
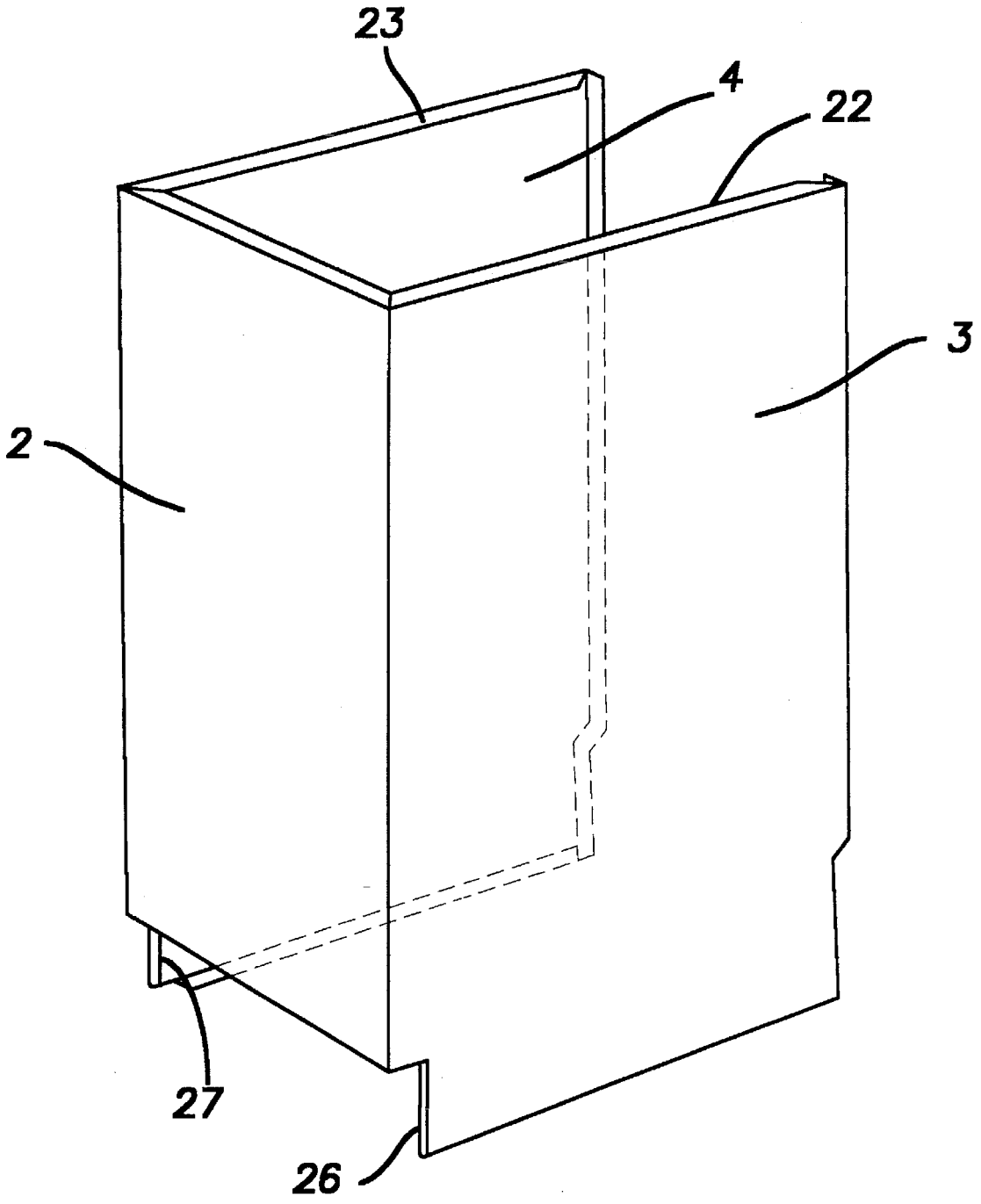
FIG. 5 shows a preferred form of the exterior of the appliance.

With reference to the diagrams, an appliance exterior is shown having several external faces. FIG. 5 shows a front part 2 and two side parts 3, 4. FIG. 4 shows an upper instrument panel 6, an upper lid 5 that closes the top of said washing machine, and a washer assembly 1, including a tub, motor, and other associated parts. These elements are supported and connected by a structure consisting of lower 8 and upper 9 bearing elements.

Referring to FIGS. 1 and 2, these two bearing elements 8 and 9 are similar to each other and together make a form resembling a card table. Each bearing element includes a rectangular support base part defining dimensions of the horizontal cross-section of the washing machine. Four columns 10*a*–13*a* and 14*a*–17*a* arranged at corresponding four corners 10–13 and 14–17 of the respective base parts are oriented perpendicularly to the rectangular base parts.

Referring to FIG. 4, these two bearing elements are produced separately from one another. During the steps of assembling the washing machine, each of these elements assumes the function of a frame for a certain number of components that comprise the machine. For example, the upper element 9 is used as a coupling element for support springs of the washer assembly 1, the upper lid 5, and the instrument panel 6. These components are associated with the controls and other control and functional elements, such as a hopper for loading the washing machine. The lower bearing element 8 is used as a support base for a back, shock absorbers, a removable filter, and other components.

In this way, it is possible to assemble practically all the functional parts of the washing machine onto the two separate bearing elements 8 and 9, which serve as assembly modules, thereby facilitating the assembly process, and reducing the time costs of production.

Referring to FIGS. 1 through 4, the two bearing elements 8 and 9 are firmly connected together. They are arranged in such a way that the upper element 9 is supported by means of the bottoms of four columns 14*a*, 15*a*, 16*a*, 17*a* projecting downwardly from respective corners. The columns 14*a*, 15*a*, 16*a*, 17*a* of the upper element 9 are supported on corresponding tops of columns 10*a*, 11*a*, 12*a*, 13*a* of the lower bearing element 8, which is positioned upside down, with its base turned toward the floor with the columns turned vertically upward. The columns are dimensioned in such a way that the assembly defines a rectangular parallelepiped.

The final structure of the washing machine is then completed after the top and bottom basic parts have been connected at the columns, in a suitable manner.

The height of the individual columns of both bearing elements 8 and 9 can also be different, depending on constraints or advantages in the assembly, so long as the total height of each of the 4 pairs of corresponding columns is equal. Similarly, the top and bottom basic parts connected to the corresponding columns can be of various shapes and dimensions, as long as they provide sufficient and stable support.

The final result of the construction described is that said bearing elements 8 and 9, after assembly, determine the shape of a vertical parallelepiped with rectangular faces, as shown in the diagrams.

Another advantage of the invention will now be clear: The structure permits free passage of light to the interior of the machine to facilitate assembly of the elements, final testing, and consequently possible corrective action or preventive maintenance during use. This offers additional advantages in ease and economy of production.

Figure 3:
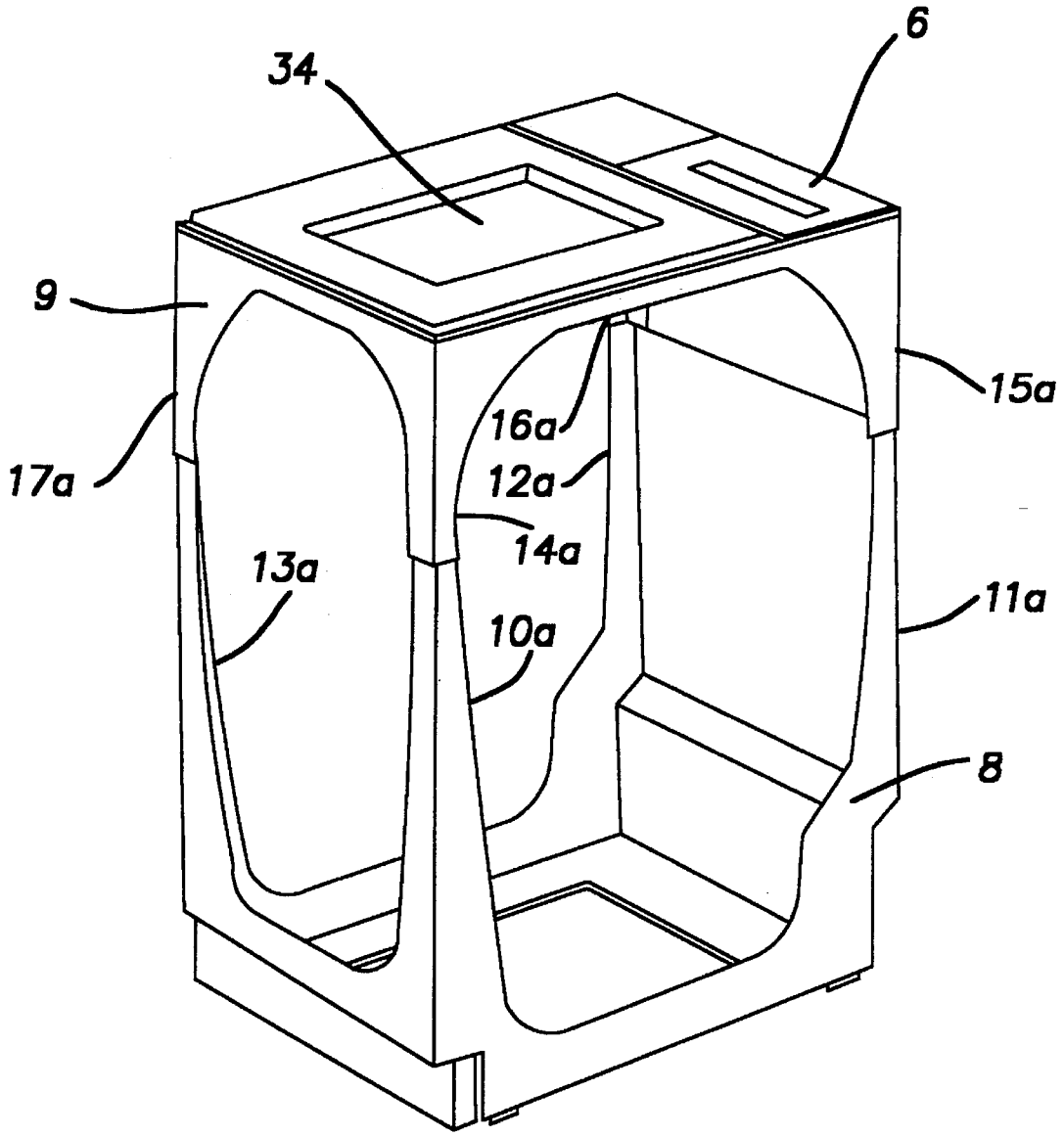
FIG. 3 shows these elements schematically, assembled together.

As shown in FIGS. 3 and 4, to take maximum advantage of the opportunity provided by this structure, the basic part of the upper structure 9 should have an opening 34 for access to a loading lid over the washer assembly 1. The upper structure 9 should be shaped along its edges so as to be covered smoothly by the lower part of the upper lid 5 when closed.

An advantageous improvement of the invention includes producing the three plates, front 2 and sides 3 and 4, of the exterior of the appliance by folding a single sheet, typically sheet metal, as shown in FIG. 5. This permits assembling and disassembling of said appliance with a single assembly operation, accelerating and simplifying this operation.

Figure 6A:
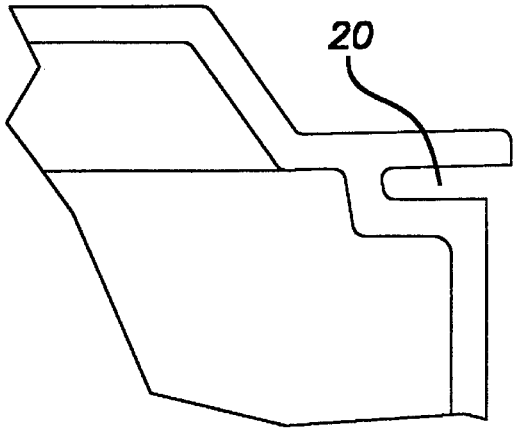
FIGS. 6 and 6A show a partial vertical front section of the upper bearing element and a detail thereof, respectively.
Figure 6:
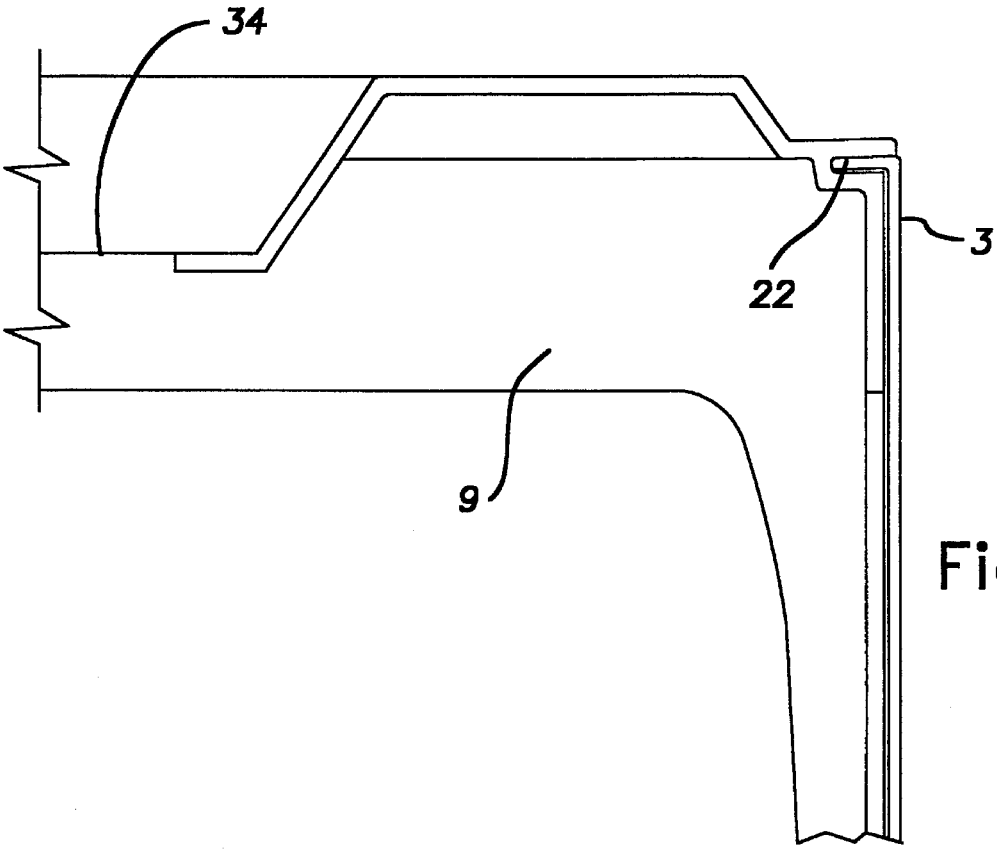

A useful improvement of these variants is shown in FIGS. 6 and 6A. Said upper support base part of said upper element 9 has horizontal grooves 20 (shown also in FIG. 1), corresponding to lateral edges of the upper element. The grooves 20 open toward the outside. Said appliance also has horizontal appendages or extensions 22, 23 (shown in FIG. 5) from the upper edges of said side plates 3, 4. The extensions are narrow and turned toward the inside, with a shape and dimensions such as to make them able to fit at least partially within corresponding horizontal grooves 20.

An analogous improvement is shown in FIGS. 7 and 7A. Said lower support base part of the lower element 8 has corresponding vertical grooves 24, 25 in lower portions of its front edges (shown also in FIG. 2). The vertical grooves 24,25 are recessed, spaced from the corners, and angled rearwardly, preferably with a curved profile, in said lower base. The lower portion of front edges of said side plates 3, 4 have corresponding vertical extensions 26, 27 (shown in FIG. 5) directed toward the inside and able to fit least at partially within said vertical grooves 24, 25.

The utility of the two improvements just described lies in the fact that by inserting said upper and lower extensions into the respective grooves, immediate and precise assembly of said appliance with respect to the internal structure is achieved, with a simple, easy, and rapid insertion operation, by sliding the two parts together.

A further improvement of the invention consists of producing said lower 8 and upper 9 elements as a unit including the corresponding top and bottom base parts and the corresponding columns. Preferably, the technique of plastic injection is used in such a way as to reduce costs and accelerate the production process and also to augment the compactness of the elements.

Finally, the technology mentioned of injected plastic also permits production of support feet 29 for the machine in said lower element 8.

What is claimed is:

1. A washing machine, comprising a top loading washer assembly (1); an appliance exterior including front (2), and side (3, 4) plates; an upper lid (5); an upper control panel (6); and support feet, characterized by the fact that:

said washer assembly, said appliance exterior, said upper lid, said panel, and said feet, are assembled and supported on a bearing structure;

said bearing structure includes distinct lower (8) and upper (9) elements;

the lower element (8) includes a lower support base having substantially a same rectangular profile as a horizontal cross-section of the washing machine;

four lower vertical columns (10*a*, 11*a*, 12*a*, 13*a*) are provided at respective corners (10, 11, 12, 13) of the lower support base wherein the lower support base is made as a unit with the lower vertical columns;

the upper element (9) includes an upper support base with substantially a same perimeter as the lower base;

four upper vertical columns (14*a*, 15*a*, 16*a*, 17*a*) are provided at respective corners (14, 15, 16, 17) of the upper element and are directed toward the base and terminate at substantially the same height wherein the upper support base is made as a unit with the upper vertical columns; and the bottoms of said upper columns are supported on tops of said lower columns, resting thereon.

2. A washing machine according to claim 1, characterized by the fact that said front plate (2) and side plates (3, 4) of said appliance exterior are produced from a single folded sheet of metal and said appliance exterior is adapted for fitting against said bearing structure so as to completely enclose corresponding side faces and front faces of the structure.

3. A washing machine according to claim 2, characterized by the fact that said upper support base of said upper element (9) is provided with horizontal grooves (20) corresponding to upper lateral corners of the base, and opening toward the exterior; and said appliance exterior is provided with corresponding horizontal extensions (22, 23) at upper edges of said side plates (3, 4) adapted to fit at least partially within said corresponding horizontal grooves.

4. A washing machine according to claim 2 or 3, characterized by the fact that said lower support base of said lower element (8) is provided with vertical grooves (24, 25) corresponding to lower parts of front corners and spaced therefrom, and projecting toward the interior of said lower base; and said appliance exterior is provided with corresponding vertical extensions (26, 27) at lower parts of lower edges of said side plates (3, 4), directed toward the inside, and adapted for fitting at least partially within said corresponding vertical grooves (24, 25).

5. A washing machine according to claim 4, characterized by the fact that said support feet (29) are made as a unit with said lower support base.

6. A washing machine according to any of claims 1 through 3, characterized by the fact that said support feet (29) are made as a unit with said lower support base.

* * * * *